US010717271B1

(12) United States Patent
Beh et al.

(10) Patent No.: US 10,717,271 B1
(45) Date of Patent: Jul. 21, 2020

(54) NON-EVAPORATIVE INK DRYING SYSTEM AND METHOD

(71) Applicant: Palo Alto Research Center Incorporated, Palo Alto, CA (US)

(72) Inventors: Eugene S. Beh, Portola Valley, CA (US); Michael Benedict, Palo Alto, CA (US); Jessica Louis Baker Rivest, Palo Alto, CA (US); David Mathew Johnson, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/236,857

(22) Filed: Dec. 31, 2018

(51) Int. Cl.
*B41J 2/005* (2006.01)

(52) U.S. Cl.
CPC ..... *B41J 2/0057* (2013.01)

(58) Field of Classification Search
CPC .... B41J 2002/012; B41J 2/01; B41J 2/04581; B41J 2/0057; B41J 11/007
See application file for complete search history.

(56) References Cited

U.S. PATENT DOCUMENTS 8,833,896 B2 9/2014 Tunmore et al.
2009/0056749 A1* 3/2009 Hori ..... B05C 1/0817 134/6
2018/0354253 A1* 12/2018 Sawin ..... B41M 5/03

OTHER PUBLICATIONS

Issadore et al., "Microwave dielectric heating of drops in microfluidic devices", Lab Chip 2009, 9 (12), 1701-6.
Klein et al., "Drop Shaping by Laser-Pulse Impact", Phys. Rev. Appl. 2015, 3 (4), 044018.
Klein et al., "Laser impact on a drop", Physics of Fluids 2015, 27 (9), 091106.

* cited by examiner

*Primary Examiner* — Jannelle M Lebron
(74) *Attorney, Agent, or Firm* — Mueting Raasch Group

(57) ABSTRACT

An apparatus for non-evaporative drying comprises a solvent permeable transfer substrate having a first surface and a second surface opposite the first surface. An ejector is configured to eject a droplet comprising at least one solvent onto the first surface of the transfer substrate. A reservoir comprising a draw solution is configured to place the draw solution in contact with the second surface of the transfer substrate, and a print substrate is configured to contact a portion of the first surface of the transfer substrate.

20 Claims, 7 Drawing Sheets

NON-EVAPORATIVE INK DRYING SYSTEM AND METHOD

TECHNICAL FIELD

This disclosure relates generally to systems for separating solvents and other fluids, such as water, from an ink droplet without using evaporation and methods of operating the same.

BACKGROUND

Inkjet printers function by ejecting small droplets (typically on the order of 1-10 picoliters) of ink in a directed fashion onto media underneath a print head. Contact of the ink droplets onto the paper forms picture elements that collectively constitute a printed image. In general, darker or lighter areas of an image require more or less ink, respectively, per unit area of the paper.

However, the use of water-based inks results in penetration of a large amount of water into the paper, or other print substrate. This creates a need for additional drying in order to enable fast printing speeds, causes undesired deformation of the paper, and places challenges on print quality due to lateral spreading of the ink. Non-aqueous solvents, which can have a much lower latent heat of vaporization than water, are not a viable alternative due to added operating costs and safety concerns arising from the production of large amounts of flammable vapors that also present health risks if inhaled. Slow-evaporating non-aqueous solvents have many of the same issues as with water. Removing a significant fraction of the water content, or other solvent(s), from ink droplets between the time they are produced (e.g., by jetting) and the time they impact the paper would mitigate or avoid these issues.

SUMMARY

Embodiments described herein are directed to an apparatus. The apparatus comprises a solvent permeable transfer substrate having a first surface and a second surface opposite the first surface. An ejector is configured to eject a droplet comprising at least one solvent onto the first surface of the transfer substrate. A reservoir comprises a draw solution and is configured to place the draw solution in contact with the second surface of the transfer substrate, and a print substrate is configured to contact a portion of the first surface of the transfer substrate.

Other embodiments are directed to a system. The system comprises a solvent permeable transfer substrate having a first surface and a second surface opposite the first surface. An ejector is configured to eject a droplet having a first osmotic pressure and comprising at least one solvent and at least one other component onto the first surface of the transfer substrate. A reservoir comprises a draw solution having a second osmotic pressure, higher than the first osmotic pressure, and the reservoir is configured to place the draw solution in contact with the second surface of the transfer substrate. A separator is coupled to the reservoir and is configured to separate the draw solution from the at least one solvent, and a print substrate is configured to contact a portion of the first surface of the transfer substrate.

Further embodiments are directed to a method. The method includes placing a droplet comprising at least one solvent onto a first surface of a solvent permeable transfer substrate. At least a portion of the solvent from the droplet is transported across the transfer substrate to a second surface of the transfer substrate, where the second surface opposes the first surface. The method further includes transferring the at least one other component and solvent remaining on the first surface of the transfer substrate to a print substrate.

The above summary is not intended to describe each disclosed embodiment or every implementation of the present disclosure. The figures and the detailed description below more particularly exemplify illustrative embodiments.

BRIEF DESCRIPTION OF THE DRAWINGS

The discussion below refers to the following figures, wherein the same reference number may be used to identify the similar/same component in multiple figures. However, the use of a number to refer to a component in a given figure is not intended to limit the component in another figure labeled with the same number. The figures are not necessarily to scale.

DETAILED DESCRIPTION

Figure 1:
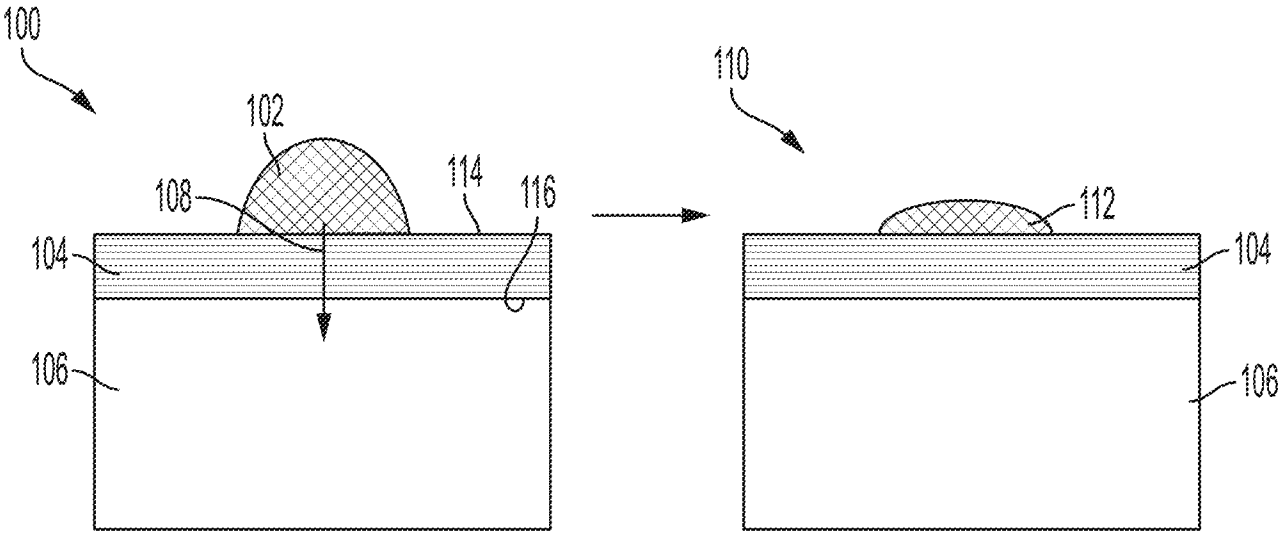
FIG. 1 is a schematic diagram of a droplet before and after solvents are transported across a transfer substrate in accordance with certain embodiments.

Inkjet printing with water-based inks results in penetration of a large amount of water into the paper, or print substrate, which causes undesirable deformation of the paper and possible degradation of print quality. Some systems for in-flight drying of ink droplets have been proposed to counteract the above-described issues with ink solvents such as water. For high-speed commercial printing, dryers are employed to rapidly remove water from the printed paper. Inks that utilize non-aqueous solvents with low vapor pressures (i.e., that have low rates of evaporation) also face the same challenges. To date, dryers have focused on evaporative removal of solvent, whether through air movement or by employing heaters.

However, the high jetting speed (about 5 m/s) and short distance between the print head and paper (about 1 mm) result in very short flight times (about 100-200 μs) during which solvent from the ink droplets must be removed. For example, in order to remove 90% of the water from a 10 pL (picoliter) droplet of aqueous ink within 200 μs, a volumetric power density of 10 MW/mL is required. This assumes that all the input energy is used to overcome the latent heat of vaporization of water and is not radiated to the environment.

Such a high volumetric power density is difficult to achieve. Laser pulses can deliver a large amount of energy to a focused area in a small amount of time, but the uneven absorption of laser energy results in droplet expansion and fragmentation. A 10 MW/mL calculated power density has been reported using a dielectric (microwave) heating system incorporated into a microfluidic cell, but the cell required fluorocarbon oil as a carrier medium to transport the water droplets. Because individual water droplets were surrounded by liquid of a different phase, no evaporation was possible. Moreover, the absorbed power density was found to be much lower at around 0.01 MW/mL.

Both laser pulsing and dielectric heating require expensive equipment that may outweigh any benefits arising from reduced drying requirements. Alternatively, the time between droplet production and impact could be substantially increased, thereby lowering the power requirements for ink evaporation. This is commonly achieved through use of an intermediate transfer surface, which can ensure that droplet registration is maintained until final transfer to a print substrate. Even then, evaporative removal of ink solvents presents challenges. The high temperatures required for speedy ink drying are detrimental to ink ejectors, which necessitates the use of heat shields or an extended length transfer belt for thermal management. Evaporated solvent from the ink can also recondense and collect on cooler surfaces before it has a chance to be vented, which is highly undesirable.

Alternative approaches, described in various embodiments herein, are directed to systems and methods for non-evaporative removal of solvents from inks utilizing an osmotic process. For example, ink droplets are jetted onto an intermediate transfer substrate surface. The transfer substrate is a membrane such as a forward osmosis membrane which a first surface receiving the droplets and a second, opposite facing surface in contact with a draw solution (e.g., having high osmotic pressure, such as a brine; having a high affinity for water, such as a concentrated aqueous solution of glycerol; or being an organic solvent, such as ethanol). The osmotic pressure of any particular ink and draw solution pair is defined herein with respect to a pure solvent which comprises the largest solvent component of the droplet. Small molecule solvents (typically having a molecular weight lower than 200 grams/mole, including water) are transported across the membrane surface through osmosis, thereby reducing the ink volume on the intermediate transfer substrate surface. The transfer substrate could comprise other types of semi-permeable membranes, which can also transport solvents, such as reverse osmosis membranes, microporous membranes, and ion exchange membranes. The ink is subsequently transferred to a print substrate after the droplet dries to a predetermined degree.

Turning to FIG. 1, a droplet before 100, and after 110, experiencing non-evaporative solvent removal is shown in accordance with embodiments described herein. Hereinafter the term non-evaporative refers to a process that removes solvent molecules from the droplet without any phase change, which occurs with conventional evaporative processes such as thermal drying or natural evaporation to the air above the droplet. The presence of a non-evaporative ink drying process is not intended to exclude any of the aforementioned conventional evaporative processes upstream, downstream, or concurrent to, the non-evaporative process. The droplet 102 may comprise one or more solvents and one or more other components such as solutes or particles. For example, an ink droplet may comprise water and other organic solvents along with pigment particles. The droplet 102 is jetted onto an intermediate transfer substrate 104. The transfer substrate 104 has a first surface 114 that receives the droplet 102 and a second, opposing surface 116. The transfer substrate 104 is a forward osmosis membrane that may be nonporous, and in certain embodiments, porous or a combination of porous and non-porous materials. If the membrane has porous elements, the acceptable size of membrane pores may be determined by the size of particles (e.g., pigments) in the droplets. For example, the pores should be smaller than the particles so that the particles do not also transport across the membrane. The second surface is in contact with a draw solution 106 that has a higher osmotic pressure, or otherwise a higher affinity for the solvent(s), than the ink that comprises the droplet 102. Thus, solvent molecules from the droplet 102 transport across the transfer substrate 104 to the draw solution 106 as shown by arrow 108. As may be seen, removal of the solvents leaves a droplet 112 having a smaller volume (i.e., the droplet is concentrated/dried) than the original droplet 102 on the first surface 114 of the transfer substrate 104.

Because printer inks include a pigment or dye in a mixture of different solvents, the rate of solvent transport would not be consistent over time. For example, the rate would slow over time due to the inorganic particles/dissolved materials/solutes holding onto solvent (e.g., water) as the volume of water in an ink droplet decreases. However, since the presence of other organic compounds, which can be thought of as solutes in water that themselves affect the osmotic pressure of the ink, will hinder the transport of water from the ink into aqueous draw solution, an organic solvent may, in some embodiments, be a more effective (e.g., increased flux) draw solution for aqueous printer inks.

In addition, the rate of solvent transport will be quickly retarded if the transported solvent is allowed to accumulate on the second surface of the membrane. Thus, the draw solution is circulated during operation using an agitator. While on a smaller scale this may be accomplished by agitating the draw solution with magnetic stirrers and/or pumps, commercial printing processes may require larger-scale agitator configurations.

Figure 2:
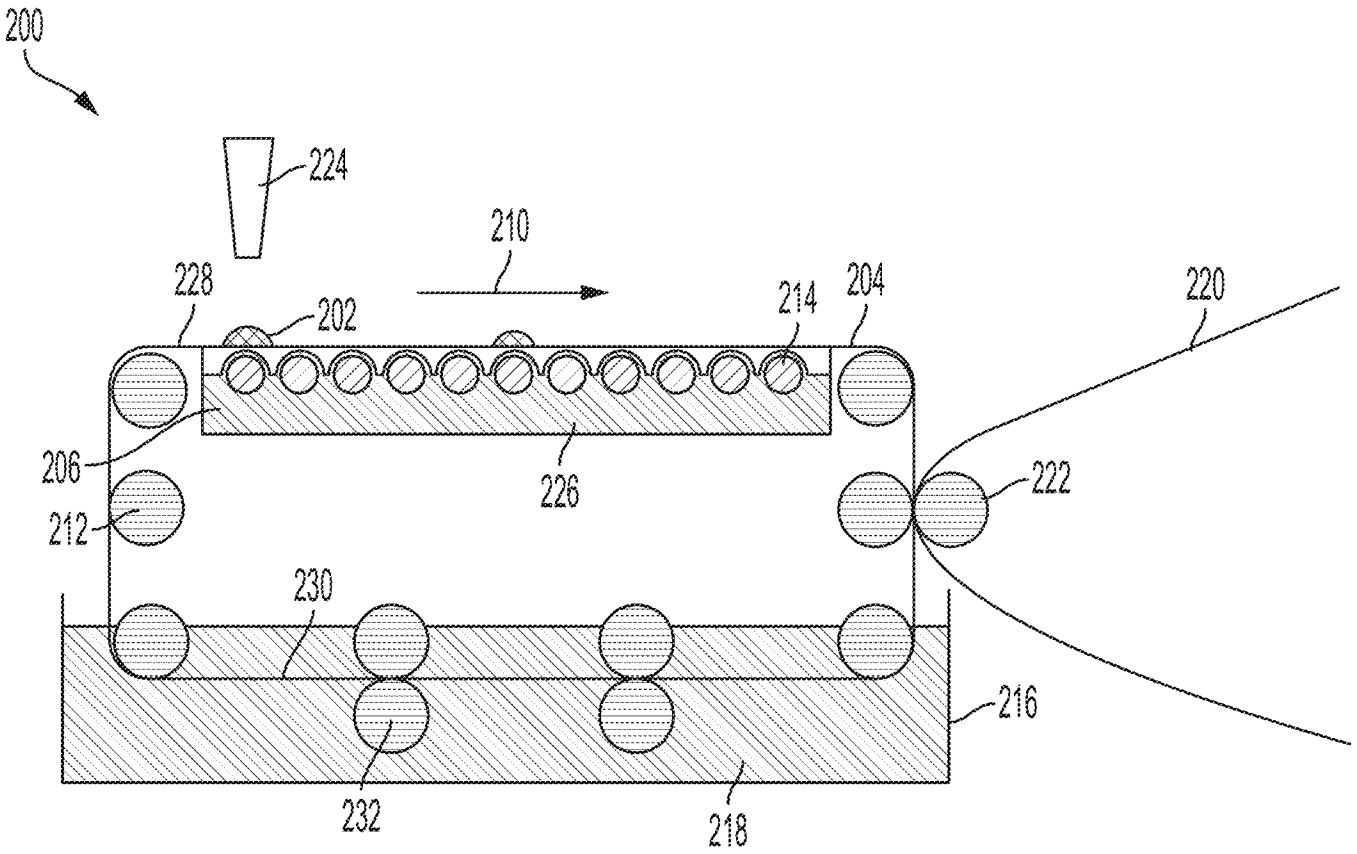
FIG. 2 is a schematic diagram of a non-evaporative solvent separation device in accordance with certain embodiments.

FIG. 2 illustrates an example system 200 for incorporating non-evaporative drying in a commercial printing process in accordance with various embodiments. The membrane (e.g., transfer substrate) 204 is structured like a conventional intermediate transfer belt and moved so that it contacts a separate reservoir 226 of the draw solution 206 before coming into contact with a print substrate 220. Ink is jetted from an ejector 224 as droplet 202 onto a first surface 228 of the membrane 204. When the ink is jetted, the membrane 204 is positioned proximate the draw solution reservoir 226 so that solvents (e.g., water) in the droplet 202 begin to transport across the membrane 204 to the draw solution 206. The membrane 204 is circulated by a plurality of rollers 212, as indicated by arrow 210, which keeps transported solvents from accumulating on the second surface 230 of the membrane 204. As the droplet is carried by the moving transfer surface, further transport/drying occurs. When adequate drying is achieved (e.g., removal of 50% of the droplet solvent volume), the droplet contacts a print substrate (e.g., paper) 220. In accordance with typical printing processes, the print substrate 220 may be circulated via rollers 222. After the ink is transferred to the print substrate 220, the membrane continues circulating through a cleaning tank 216. The cleaning tank includes solvent 218 for cleaning residual ink from the transfer substrate 204 before that portion of the transfer substrate returns to the ejector to receive subsequent droplets. The cleaning process can be enhanced through contact with the transfer substrate such as by wiping means or rollers 232 submerged within the cleaning solvent 218, in addition to similar cleaning elements to remove excess cleaning solvent after emerging from tank 216.

In certain embodiments, the draw solution is further agitated by a second plurality of rollers 214 positioned within the draw solution reservoir 226. The second plurality of rollers 214 contact the draw solution 206 and bring a portion of the draw solution 206 in contact with the second surface 230 of the membrane 204, while also removing transported solvents from the immediate vicinity of the second surface 230 of the membrane 204. Agitation also serves to control concentration gradients within the draw solution. Alternatively, the draw solution 206 can be pumped in such a way that it comes in contact with, and flows relative to, the second surface 230 of the membrane 204. The flow distribution of draw solution 206 can be controlled by appropriate channels or fins, in order to reduce or minimize spatial variations in the removal of transported water away from the second surface 230 of the membrane 204.

Figure 3:
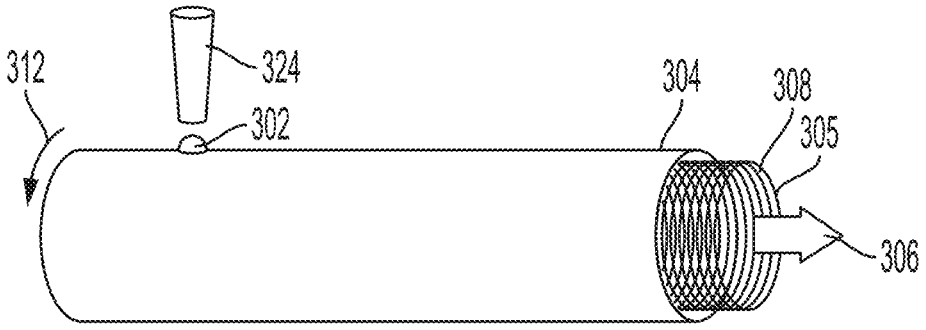
FIG. 3 is a schematic diagram of a non-evaporative solvent separation device in accordance with certain embodiments.

FIG. 3 illustrates an alternative embodiment for implementing non-evaporative drying in a printing process. Here, the forward osmosis membrane 304 is wrapped around a tube 305 through which the draw solution 306 is circulated. Tube 305 has a plurality of openings 308, such as perforations, pores, or any sort of void space arising from the structure of tube 305. Tube 305 may be made of materials capable of providing structural support such as metal, plastic, or a woven surface so long as there are a plurality of openings for the draw solution to contact a surface of the transfer substrate. The draw solution 306 is contained in a reservoir within the tube, or the tube 305 serves as the reservoir.

An ejector 324 jets ink droplets 302 onto an external surface of the membrane 304. The solvent transport then proceeds as described above through osmosis. The draw solution 306 is flowed through the tube thereby removing solvents from the ink droplets 302 away from the back, internal side of the membrane 304, through the openings 308. The tube 305 is rotated in conjunction with the membrane 304 (e.g., via an axle through an open center portion of the tube 310, or through frictional contact with a different roller), as indicated by arrow 312, thereby moving the droplet 302 away from the ejector 324 and towards eventual transfer to a print substrate. The rotation serves to agitate the draw solution 306 within the tube; however, additional agitating elements may be included within the draw solution reservoir. Agitation also serves to control concentration gradients within the draw solution. For example, in certain embodiments, a concentration gradient along the angular dimension of the tubular draw solution reservoir may be preferred over a concentration gradient in the lengthwise dimension.

In certain embodiments, the draw solution is recycled or disposed of. If the draw solution is inexpensive (e.g., aqueous sodium chloride), and the components of the ink that are transported can be safely released to the environment, simple disposal of the draw solution may suffice. However, if the draw solution or transported ink components are expensive or hazardous, the draw solution can be regenerated, i.e., purified, e.g., through distillation. The distillation process is similar to thermal processes for water desalination. For example, ethanol is more volatile than many components in aqueous inks. If ethanol is used as a draw solution, it can easily be separated from the transported ink components, which themselves could be reused in a new batch of aqueous ink. If a solution of a nonvolatile inorganic or organic material is used as the draw solvent, distillation could remove the comparatively more volatile draw solution solvent as well as water and solvents that have been absorbed from the ink, thereby reconcentrating the draw solution. Reusing the solvents absorbed from the ink could enable significant cost savings with respect to the cost of the ink.

Figure 4:
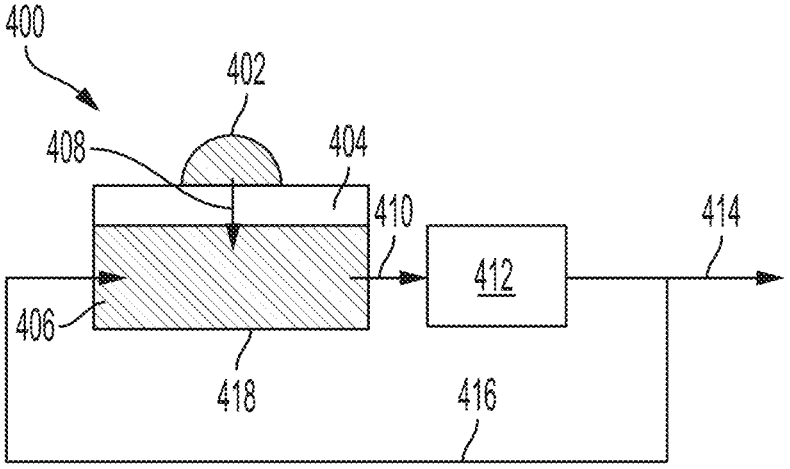
FIG. 4 is a schematic diagram of a non-evaporative solvent separation device including regeneration of a draw solution in accordance with certain embodiments.

FIG. 4 illustrates a system 400 of non-evaporative solvent removal coupled with a separation system for the draw solution. As discussed above, a droplet 402 is provided on a first surface of a transfer substrate 404. Water and/or other solvents transport through the transfer substrate 404 via osmosis as indicated by arrow 408 to a second, opposing surface of the transfer substrate 404 and subsequently into the draw solution 406. This may be achieved in accordance with any of the embodiments described herein. At a predetermined point of dilution of the draw solution, or as a continuous process, the draw solution is directed out of the reservoir 418 as indicated by arrow 410. The draw solution, including any ink components that have been transported through the transfer substrate 404, is provided to a separation system 412. Example separation processes include distillation and electrochemical separation procedures. The separation system 412 produces a purified draw solution stream 416 and at least one other stream 414 comprising the ink components (e.g., water and other solvents) that were transported across the transfer substrate and have been removed from the used draw solution.

Using aqueous ink and ethanol as the draw solution as one example, the stream 410 may include ethanol, water, glycerol, and other organic solvents originally present in the ink such as 2-pyrrolidinone. The purified stream 416 then comprises mostly ethanol and is recycled back to the draw solution reservoir 418. The recycling of the fluid can also support agitation of the draw solution 406 within the reservoir 418. The remaining at least one stream 414 may include the less volatile components of stream 410 such as water, glycerol, 2-pyrrolidinone, and other organic solvents. These components may be disposed, separated further, and/or recycled for further ink production. Using aqueous ink and a concentrated aqueous glycerol solution as another example, the stream 410 may include water, glycerol, and other organic solvents originally present in the ink such as 2-pyrrolidinone. The purified stream 416 then contains a lowered water content and the remaining at least one other stream 414 comprises mostly water.

Figure 9:
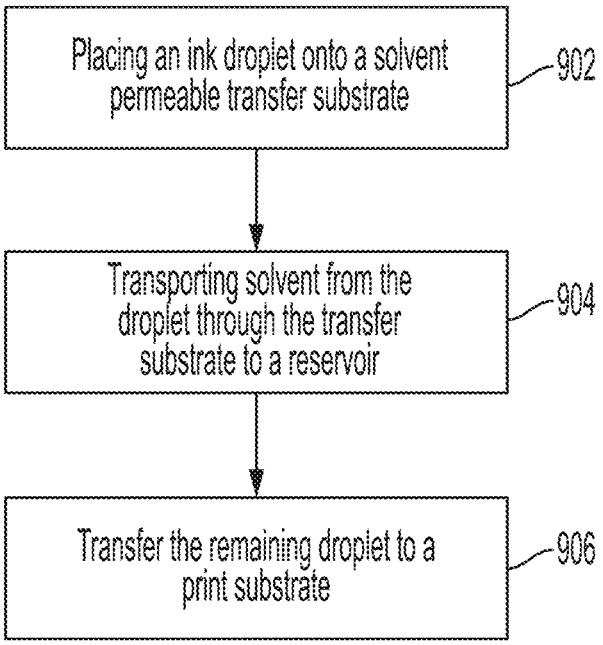
FIG. 9 is a flow diagram of a method in accordance with certain embodiments.

Processes for separating solvents from an ink are further described in connection with FIG. 9. Ink, such as a droplet, is introduced to the system by being jetted from an ejector onto a first surface of a transfer substrate 902. The droplet may include one or more solvents, including water, and at least one other component. Other components may include various solutes, latex, and pigments. Since the transfer substrate is a solvent permeable membrane, the water and/or other organic solvents transfer from the first surface to a second, opposing surface (e.g., to a reservoir holding a draw solution) 904. The water and/or other solvents are transported naturally in response to osmotic pressure differentials, without application of outside forces. After removal of a sufficient, predetermined amount of water and/or solvents, the partially dried ink droplet is subsequently transferred to a print substrate 906. The process may optionally include cleaning the transfer substrate prior to the transfer substrate receiving subsequent droplets and/or regeneration of the draw solution onsite or at another location.

The net effect of the non-evaporative ink drying system is to remove solvents (such as water) from inkjet inks without having to work against their low volatility and high latent heat of vaporization. Preliminary experiments on water and aqueous inkjet inks, discussed below, show that the rate of solvent transport is sufficiently fast for these systems to be reasonably sized and that subsequent transfer onto a print substrate is not problematic. Incorporation of a non-evaporative ink drying system into a printer would allow for large energy savings while removing the need for complex thermal management that is otherwise necessary when using powerful thermal dryers. Any energy inputs would be limited to an optional regeneration of the draw solution, which itself could be separately located from the printer at a separate facility. Solvents removed from the ink could be reused to make more ink, which would lead to lower environmental impact and increased cost savings.

EXAMPLES

Preliminary validation of the osmotic ink drying was completed using a cellulose triacetate (CTA) forward osmosis membrane purchased from FTSH2O. With a draw solution of 4 M sodium chloride solution in water, a 10 μL water droplet sitting on the surface of the membrane has a roughly hemispherical shape and is completely transported in about four minutes at room temperature. This translates to a water flux of 17 $L/m^2$ h. At this flux, complete water transport will occur within 2.4 seconds for a 10 pL water droplet.

In place of the concentrated salt solution (i.e., brine), an organic solvent that contains little water can also serve as a good draw solution for water transport, even when the donating fluid contains other solvents or solutes which would be expected to increase in concentration as more water is transported. With absolute ethanol as the draw solution, a 10 μL water droplet is completely transported across the membrane in about three minutes.

Simple qualitative experiments were performed with two different ink compositions (A and B). Composition A is a mixture of solvents that closely resembles a commercial aqueous pigmented ink (Collins PWK 1223), but which omits any pigment and dissolved latex to facilitate experimental observation. Composition B is a pigmented black ink (Impika A0011533 HD2) that contains carbon black as the pigment. The compositions of the inks are further detailed below in Table 1A (composition A) and Table 1B (composition B).

TABLE 1A

| | |
|---|---|
| Water | 63% |
| Glycerol | 12% |
| 2-pyrrolidone | 3% |
| 1,2-hexanediol | 3% |
| 2-butoxyethanol | 3% |
| 1,3-propanediol | 15% |
| Surfynol 104H | 1% |
| Total | 100% |

TABLE 1B

| | |
|---|---|
| Water | 50-60% |
| Glycerol | 20-30% |
| 2-pyrrolidone | 1-10% |

TABLE 1B-continued

| | |
|---|---|
| Carbon black | 1-10% |
| Propylene glycol | 4.99 |
| Triethylene glycol monobutyl ether | <5 |
| 1,2-benzisothiazolin-3-one | <0.05 |
| Total | 100% |

Both ink formulations were tested on the forward osmosis membrane with either 4 M sodium chloride or absolute ethanol as the draw solution. The results of the observed behavior of various fluid droplets (water, Composition A, and Composition B) with respect to various draw solutions (none, 4 M sodium chloride, and ethanol) on the FTSH2O forward osmosis membrane are compiled in Table 2 below.

TABLE 2

| | Water | Composition A (no pigment) | Composition B (black pigment) |
|---|---|---|---|
| None (glass surface, no membrane) | No change after 30 minutes | No change after 30 minutes | No change after 30 minutes |
| 4M NaCl | Complete transport in 4 minutes | No obvious transport observed | No obvious transport observed after 10 minutes |
| Ethanol | Complete transport in 3 minutes | No obvious transport observed | Solvent transport observed after 10 minutes |

While no transport of Composition A could be visually observed after ten minutes, Composition B showed signs of drying at the edges of the drop after about two minutes when using ethanol as the draw solution. Thus, not every ink is compatible with the forward osmosis membrane. Even though about 80% of Compositions A and B are shared components, there is a large difference in their transport across the forward osmosis membrane. Therefore, care should be taken to identify any compounds which could react with, or deactivate, the membrane. The observed behavior of the different ink compositions under different conditions was based on visual observation because it is difficult to estimate the volume of a liquid droplet solely from its appearance. Thus, the results of Table 2 are qualitative, not quantitative. However, it was clear whether or not solvent transport occurred for each set of conditions.

Figure 5:
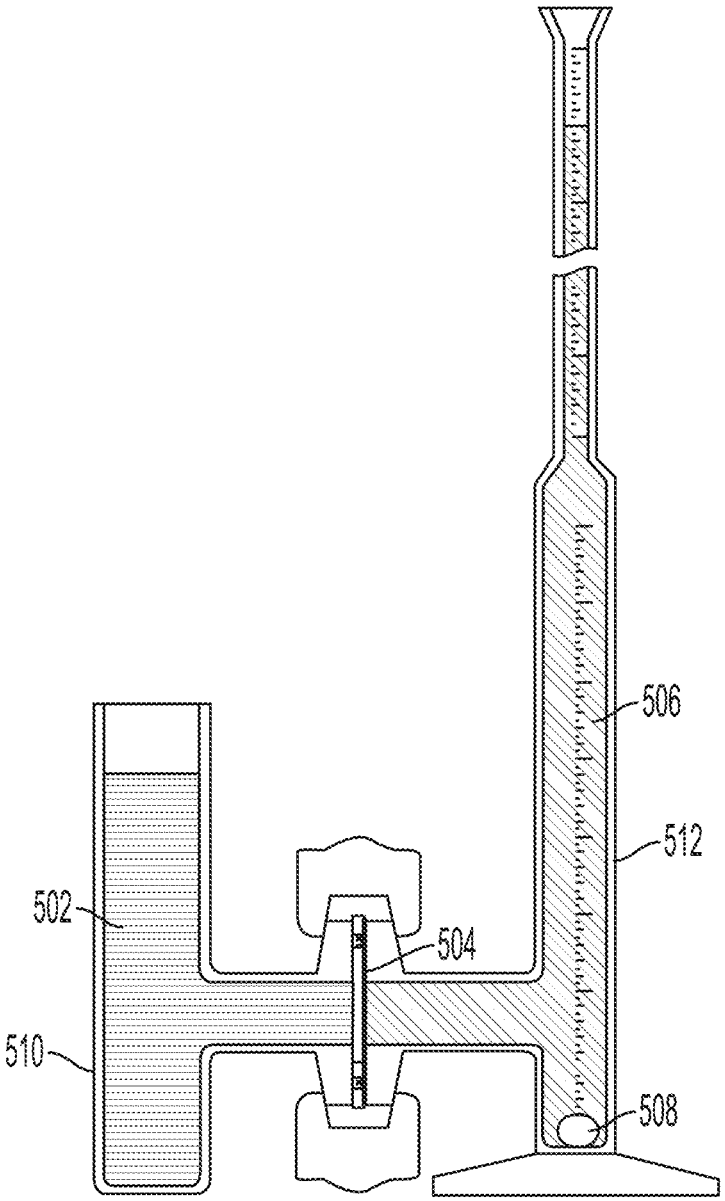
FIG. 5 is a schematic diagram of a test configuration.

For quantitative analysis, a bench top test setup was constructed as shown in FIG. 5. The ink composition sample (or water) 502 was placed in a first chamber 510 that is fluidly coupled to a second chamber (e.g., a graduated cylinder) 512 having graduations in increments of 0.01 mL (10 μL). The sample draw solution 506 is placed in the graduated cylinder 512. The forward osmosis membrane 504 is positioned between the first chamber 510 and second chamber 512 initially separating the sample ink composition (or water) 502 and draw solution 506 so that the sample ink composition is delivered directly to the front of the membrane 504 while the back of the membrane 504 remains in contact with the draw solution 506. A magnetic stir bar 508 is used to agitate the draw solution 506. The sample ink composition (or water) 502 is either agitated using a separate magnetic stir bar or is rapidly circulated using a peristaltic pump. Using this setup, the membrane flux is calculated from the change in volume of the draw solution over a certain period of time.

The quantitative results of solvent flux measurements for a variety of draw solutions, listed in order of increasing strength/flux, are summarized in Table 3 below.

TABLE 3

| Draw Solution | Donating Solution | Flux ($L/m^2h$) | Time to dry a 5 pL hemispherical droplet (sec) |
|---|---|---|---|
| 1-Butanol | Water | −8.6 | N/A |
| 1-Hexanol | Water | −0.16 | N/A |
| Methanol | Water | 1.3 | 24.7 |
| Ethanol | Water | 1.3 | 24.7 |
| 1-Propanol | Water | 2.8 | 11.5 |
| Triethylene glycol monobutyl ether | Water | 4.2 | 7.6 |
| Hexalene glycol | Water | 5.0 | 6.4 |
| 2,3-Butanediol | Water | 6.7 | 4.8 |
| Isopropanol | Water | 7.9 | 4.1 |
| 1,3-propanediol | Water | 8.9 | 3.6 |
| Propylene glycol | Water | 12.5 | 2.6 |
| Glycerol | Water | 16.7 | 1.9 |
| 40% LiCl | Water | 37.8 | 0.84 |

Using the two strongest solvents above and the quantitative test setup, the transport of various inks was again tested. The results of solvent flux measurements for a variety of ink compositions with respect to these two draw solutions are summarized in Table 4 below.

TABLE 4

| Draw Solution | Ink | Cosolvent | Flux ($L/m^2h$) | Time to dry a 5 pL hemispherical droplet (sec) |
|---|---|---|---|---|
| 50% Glycerol | Impika HD2 A0011533 | ~30% glycerol | 1.31 | 24.4 |
| | Impika HF 008R13243 | Unknown | 2.24 | 14.3 |
| | Cabot Cab-o-jet 300 | None | 12.7 | 2.5 |
| | DyStar Jettex SDP Black | None | 12.7 | 2.5 |
| 40% LiCl | Impika HF 008R13243 | Unknown | 5.95 | 5.4 |

Again, differing ink compositions have different transport rates using the same draw solution. However, with respect to the Impika HF008R13243, the stronger draw solution, 40% LiCl, had faster time to dry that was consistent with the increased drying time with respect to the water data provided in Table 3. Cabot Cab-o-jet 300 and DyStar Jettex SDP Black are black pigment dispersions that are typically mixed with other cosolvents to form an ink formulation. They have comparatively higher transport rates because of the absence of any cosolvents which have their own contributions to the osmotic pressure of the ink.

Figure 6:
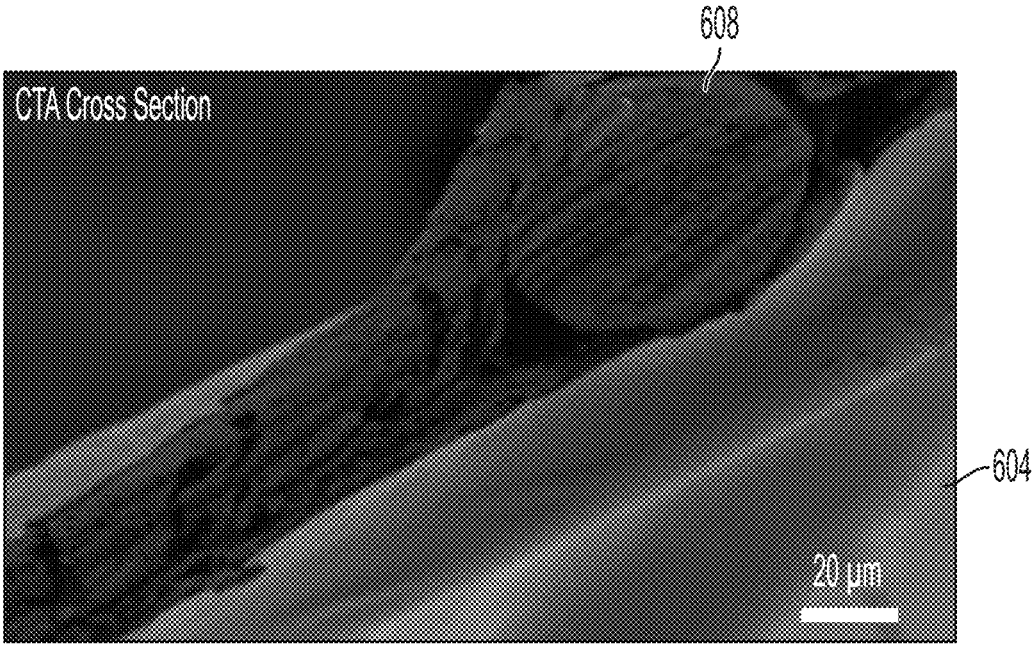
FIG. 6 is a photograph of a cellulose triacetate membrane.
Figure 7:
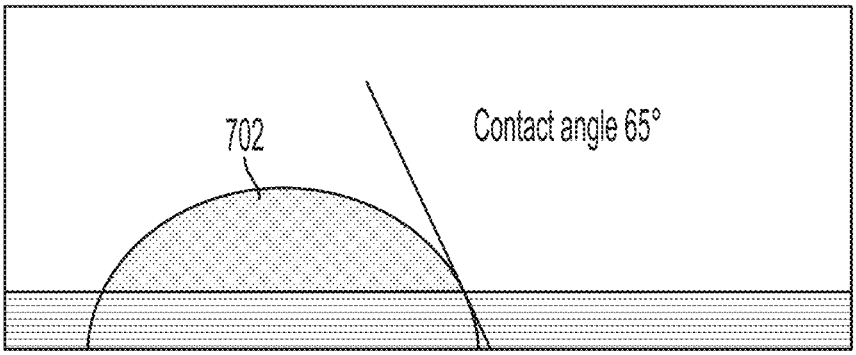
FIG. 7 is a schematic drawing of a water droplet on a cellulose triacetate membrane.

After a sufficient volume of solvent is removed from the ink droplet (e.g., typically 10-90%), the ink is transferred from the first surface of the transfer substrate to a print substrate. As discussed above, the transfer substrate, i.e., membrane, used herein was cellulose triacetate (CTA). It is a material that has been optimized for water transport by being nonporous and surprisingly hydrophobic. This may be seen FIGS. 6 and 7. In FIG. 6 a cross section of a CTA membrane surface is shown indicating a smooth, pore-free surface at the bottom right 604 along with a supporting polymer matrix (the dark gray diagonal feature) 608. The hydrophobic nature is shown in FIG. 7 where a water droplet 702 has a contact angle of 65° on the CTA membrane surface. The contact angle was measured on a drop goniometer using the sessile drop technique. The measured contact angle is similar to that reported for nylon 6,6, and the nonporosity of the membrane, though not required in all embodiments, makes the membrane less likely to trap pigment particles.

Figure 8A:
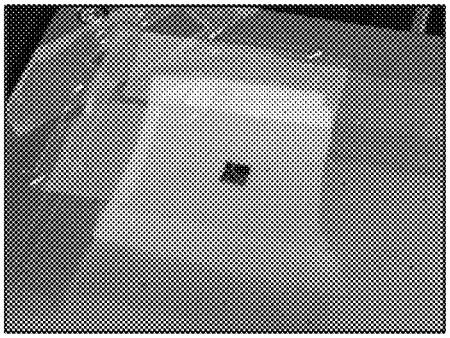
FIG. 8A is a photograph of a membrane in accordance with certain embodiments after ink has been ejected onto the membrane.
Figure 8B:
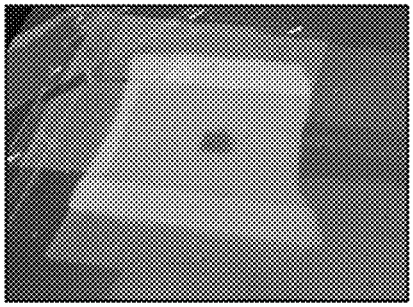
FIG. 8B is a photograph of the membrane of FIG. 8A after the ink was transferred to a print substrate.
Figure 8C:
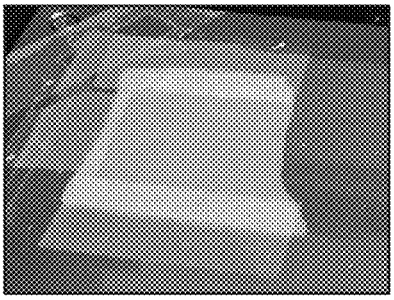
FIG. 8C is a photograph of the membrane of FIG. 8B after the membrane is wiped with a damp paper towel.

These properties enable ink that has been jetted onto the membrane surface to be easily transferred to paper (or other print substrates) with little retention on the membrane. This was demonstrated by directly printing 5 mm×5 mm squares of black ink (Impika HD2 A0011533) onto a CTA membrane using a Dimatix 2800 printer. The squares were then immediately pressed onto paper at a pressure of about 10 psi. Most, but not all, of the ink was transferred. This is shown in FIGS. 8A-C. FIG. 8A shows the membrane after the ink square is printed/jetted on the surface; FIG. 8B shows the same membrane after printing the square onto paper; and FIG. 8C shows the same membrane after being gently wiped with a damp paper towel. The cleaning removed all traces of pigment, and repetition of the procedure two subsequent times did not yield any apparent accumulation of pigment on the membrane surface.

However, the membrane was observed to dry out and become more brittle after about five minutes if printing were to be done onto a membrane that had just been blotted dry. Thus, printing was done with a very small volume of water trapped between the membrane and an underlying plastic sheet substrate to keep the membrane hydrated indefinitely as long as liquid was present under it. The ink was also observed to form droplets instead of spreading evenly on the membrane surface. This may be due to the surface energy of the membrane being too low or the surface not being perfectly flat due to the woven polymer reinforcement under it.

As set forth above, various embodiments directed to non-evaporative drying of ink can be implemented to improve printing processes. The process and system can remove volatile components such as water without evaporation or vapor condensation issues. Without the thermal components and management, non-evaporative separation consumes less energy, does not require thermal protection for other equipment, and the increased droplet drying speed enables small printing device sizes.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The foregoing description has been presented for the purposes of illustration and description. It is not intended to be exhaustive or to limit the embodiments to the precise form disclosed. It is also not intended to limit the embodiments to aqueous inks or inks that contain water. Many modifications and variations are possible in light of the above teachings. Any or all features of the disclosed embodiments can be applied individually or in any combination and are not meant to be limiting, but purely illustrative. It is intended that the scope of the invention be limited not with this detailed description, but rather, determined by the claims appended hereto.

What is claimed is:

1. An apparatus, comprising:

a solvent permeable transfer substrate having a first surface and a second surface opposite the first surface;

an ejector configured to eject a droplet comprising at least solvent onto the first surface of the transfer substrate;

a reservoir comprising a draw solution and configured to place the draw solution in contact with the second surface of the transfer substrate; and a print substrate configured to contact a portion of the first surface of the transfer substrate.

2. The apparatus of claim 1, wherein the reservoir includes an agitator.

3. The apparatus of claim 1, wherein the transfer substrate comprises a continuous loop and is circulated via a plurality of rollers.

4. The apparatus of claim 3, further comprising a cleaning tank positioned to receive the transfer substrate after the transfer substrate contacts the print substrate.

5. The apparatus of claim 1, wherein the transfer substrate comprises a continuous tube and is coaxial with a porous tube smaller in diameter, wherein the reservoir is positioned within the porous tube.

6. The apparatus of claim 1, wherein the draw solution has a higher osmotic pressure relative to the droplet.

7. The apparatus of claim 1, wherein the transfer substrate comprises a semi-permeable membrane that is at least one of a forward osmosis membrane, a reverse osmosis membrane, a microporous membrane, and an ion exchange membrane.

8. The apparatus of claim 1, wherein the droplet comprises aqueous ink.

9. The apparatus of claim 1, wherein the draw solution comprises at least one of an inorganic salt, organic salt, organometallic salt, ionic liquid, alcohol, polyol, carbohydrate, and aqueous or non-aqueous solutions thereof.

10. A system comprising:

a solvent permeable transfer substrate having a first surface and a second surface opposite the first surface;

an ejector configured to eject a droplet having a first osmotic pressure and comprising at least one solvent and at least one other component onto the first surface of the transfer substrate;

a reservoir comprising a draw solution having a second osmotic pressure higher than the first osmotic pressure, the reservoir being configured to place the draw solution in contact with the second surface of the transfer substrate; and a print substrate configured to contact a portion of the first surface of the transfer substrate.

11. The system of claim 10, wherein the transfer substrate comprises a semi-permeable membrane that is at least one of a forward osmosis membrane, a reverse osmosis membrane, a microporous membrane, and an ion exchange membrane.

12. The system of claim 10, wherein the droplet comprises aqueous ink.

13. The system of claim 10, wherein the reservoir includes an agitator.

14. The system of claim 10, further comprising a separator coupled to the reservoir configured to separate the draw solution from the at least one solvent.

15. The system of claim 14, wherein the separator produces a regenerated draw solution and is configured to recycle the regenerated draw solution to the reservoir.

16. The system of claim 10, wherein the transfer substrate comprises a continuous loop and is circulated via a plurality of rollers.

17. A method, comprising:

placing a droplet comprising a solvent and at least one other component onto a first surface of a solvent permeable transfer substrate;

transporting at least a portion of the solvent from the droplet across the transfer substrate to a second surface of the transfer substrate, the second surface opposing the first surface; and transferring the at least one other component and solvent remaining on the first surface of the transfer substrate to a print substrate.

18. The method of claim 17, wherein the second surface of the transfer substrate is proximate a draw solution having a higher osmotic pressure than the droplet and the portion of solvent is transported by osmosis.

19. The method of claim 18, further comprising circulating the draw solution away from the second surface of the transfer substrate.

20. The method of claim 18, further comprising circulating the transfer substrate relative to the draw solution while the solvent is transported across the transfer substrate.

* * * * *